US011033447B1

(12) United States Patent
Boghozian Savarani et al.

(10) Patent No.: US 11,033,447 B1
(45) Date of Patent: Jun. 15, 2021

(54) REHABILITATION WHEELCHAIR

(71) Applicants: Sirop Boghozian Savarani, Glendale, CA (US); Arsineh Boghozian Savarani, Glendale, CA (US)

(72) Inventors: Sirop Boghozian Savarani, Glendale, CA (US); Arsineh Boghozian Savarani, Glendale, CA (US)

( * ) Notice: Subject to any disclaimer, the term of this patent is extended or adjusted under 35 U.S.C. 154(b) by 206 days.

(21) Appl. No.: 16/501,326

(22) Filed: Mar. 26, 2019

Related U.S. Application Data

(63) Continuation-in-part of application No. 15/731,745, filed on Jul. 27, 2017, now abandoned.

(60) Provisional application No. 62/600,235, filed on Feb. 17, 2017.

(51) Int. Cl.
*A61G 7/10* (2006.01)
*A61G 5/14* (2006.01)

(52) U.S. Cl.
CPC ..... *A61G 7/1007* (2013.01); *A61G 5/14* (2013.01); *A61G 7/1015* (2013.01); *A61G 7/1019* (2013.01); *A61G 7/1046* (2013.01)

(58) Field of Classification Search
CPC .. A61G 5/1002; A61G 7/1019; A61G 7/1007; A61G 7/1051; A61G 5/107
USPC ..... 297/14
See application file for complete search history.

(56) References Cited

U.S. PATENT DOCUMENTS 5,255,934 A * 10/1993 Wilson ..... A61G 5/045 180/907
6,003,171 A * 12/1999 Jones, Jr. ..... A61G 5/1002 4/254
6,209,901 B1 * 4/2001 Patel ..... A61G 5/1002 280/304.1
2013/0168945 A1 * 7/2013 Pivato ..... A61G 7/1051 280/304.1
2014/0042727 A1 * 2/2014 Musham ..... A61G 5/107 280/304.1
2020/0405552 A1 * 12/2020 Yoon ..... G06F 3/167

* cited by examiner

*Primary Examiner* — Sarah B McPartlin

(57) ABSTRACT

Design and build new models of wheelchair also design and build equipment for installing on some types of wheelchairs that are in the market for sale, that by using them user will be able to do their personal basic daily tasks without others help. This wheelchair includes a pair of lifting members mounted on said rehabilitation wheelchair for enabling said lifting members to move upward and downward and a moving seat mounted on said rehabilitation wheelchair for enabling user to sit on toilet bowl directly, wherein said moving seat being compressed and said lifting members moving user downward and user sitting on toilet for doing toilet. The user can use this system for changing clothes, washing, doing toilet, moving body vertically up and down, using oven for cooking, picking up materials from higher places that cannot be reached by user, and all actions that involve getting up and picking up.

7 Claims, 14 Drawing Sheets

REHABILITATION WHEELCHAIR

CROSS-REFERENCE TO RELATED APPLICATIONS

This is continuation-in-part of application Ser. No. 15/731,745, filed, with the title "Rehabilitation Wheelchair" and naming Sirop Boghozian Savarani and Arsineh Boghozian Savarani as inventors the entire content of which is hereby incorporated herein by reference.

This application claims the benefit of priority of application No. 62/600,235 filed on Feb. 17, 2017, the entire content of which is hereby incorporated herein by reference.

TECHNICAL FIELD

The present disclosure relates to wheelchairs, and more specifically design and build new type of wheelchair and equipment for installing on some types of wheelchairs, that by using them paralyzed person will be able to do his/her personal daily tasks without others help.

BACKGROUND

Wheelchairs have been used for a long time, to improve quality of paralyzed people lives and developed easier and happier life for people, all around the world. In all the history, disability has been severe, and it has been one of the most significant and complicated problems of human.

The main problems of paralyzed people are personal tasks in daily basis, for example changing underwear and other clothes, and using the restroom (urine and stool), cleaning up, which is still getting done by help of others (for all young people, adults and old people).

Imagine paralyzed person wants to change his underwear or t-shirt, he has to ask someone else, so he can change the underwear or use the restroom. If we can imagine how hard is changing clothes and underwear, we will understand that using the restroom (urine or stool) is difficult for paralyzed people.

It's not about asking others help for simple tasks, but also how much frustration and shame paralyzed person has to go through for asking help, and this is not all of it. Lifting paralyzed person, taking off underwear, putting basin under him, wait for him to use the restroom . . . (Imagine for one second). After using the restroom, how he is going to ask other people help him, taking the basin away, cleaning his body, then putting on his clothes (underwear, and shorts) . . . for one moment look at all these hassles, and imagine you are paralyzed. Do you know someone in the whole world that getting all these tasks done by someone else for him is without frustration and shame?

Some people think that after a while these problems are going to be something normal for that person. It will be a big mistake, if you think these problems will be simple and without frustration. Yes, think a little bit and then answer.

Imagine no one is home and paralyzed person needs to go to restroom, this is the question what he is going to do?

These problems have deep effect on paralyzed person's mind and they lead him to mental illness, and he will be in fight with himself his whole life. Of course it's going to cause more complicated problems for him, people around him, and also people who live with him.

We want to mention that:

1. Most paralyzed people are from middle class or lower class of society and they don't have options to do daily tasks by themselves which costs thousands of dollars.

2. Rich people besides wheelchair have servants and people who help them in day to day life, and they don't have these problems.

SUMMARY

Designing and building new type of the wheelchair where paralyzed person can move himself up and down and do toilet and his basic daily tasks, cooking, cleaning, washing the dishes, reaching higher drawers, etc.

The concept that paralyzed person is forced to use a device called wheelchair that is in fact a mobile chair, it's been proven, unless professionals, using modern medical knowledge can help them, move on their feet a little, which is of course really hard and expensive and few paralyzed people can use that. With more thinking about this subject, the system should be invented that is included almost all paralyzed people, so they can get out of this situation and using this system at least do some part of their daily tasks. Paralyzed person needs water and food and he has other basic daily tasks like normal person, and based on that he has daily tasks that they should be done, and these daily tasks are described below:

1. Washing
2. Changing the clothes
3. Taking a shower
4. Cooking, washing the dishes, cleaning up where he lives, washing the clothes
5. Doing toilet
6. Physical and mental activities
7. Other daily tasks The conditions that these equipment have and new (designed) wheelchairs are described below:

1. They are not heavy, so that while using it paralyzed person don't have any problems.
2. It's not complicated, and using it, is really easy and comprehensible for common people.
3. It's reliable in terms of mechanics and electrics (we can use home electricity).

According to mentioned points above, design and build new models of wheelchairs, and design and build equipment that are installable on some types of wheelchairs being sold in the market, has been done, so that paralyzed person can do his personal daily tasks (mentioned above) without others help, of course in these designs daily tasks will be done faster, easier and more hygienic.

But doing daily tasks and in general creating movements, either physical or mental in paralyzed person is the same as feeling of the life and being alive that is being flourished in his existence and these actions are causing him not to feel like a burden anymore and even feel more independent. So he will be in much better situation emotionally. So that he can have specific schedule in his daily life, even like a normal person with complete physical health.

The result of this project is that paralyzed person is participating in social life as normal person, and in result he will have much better mental and physical health.

DRAWINGS—REFERENCE NUMBERS

Figure 1:
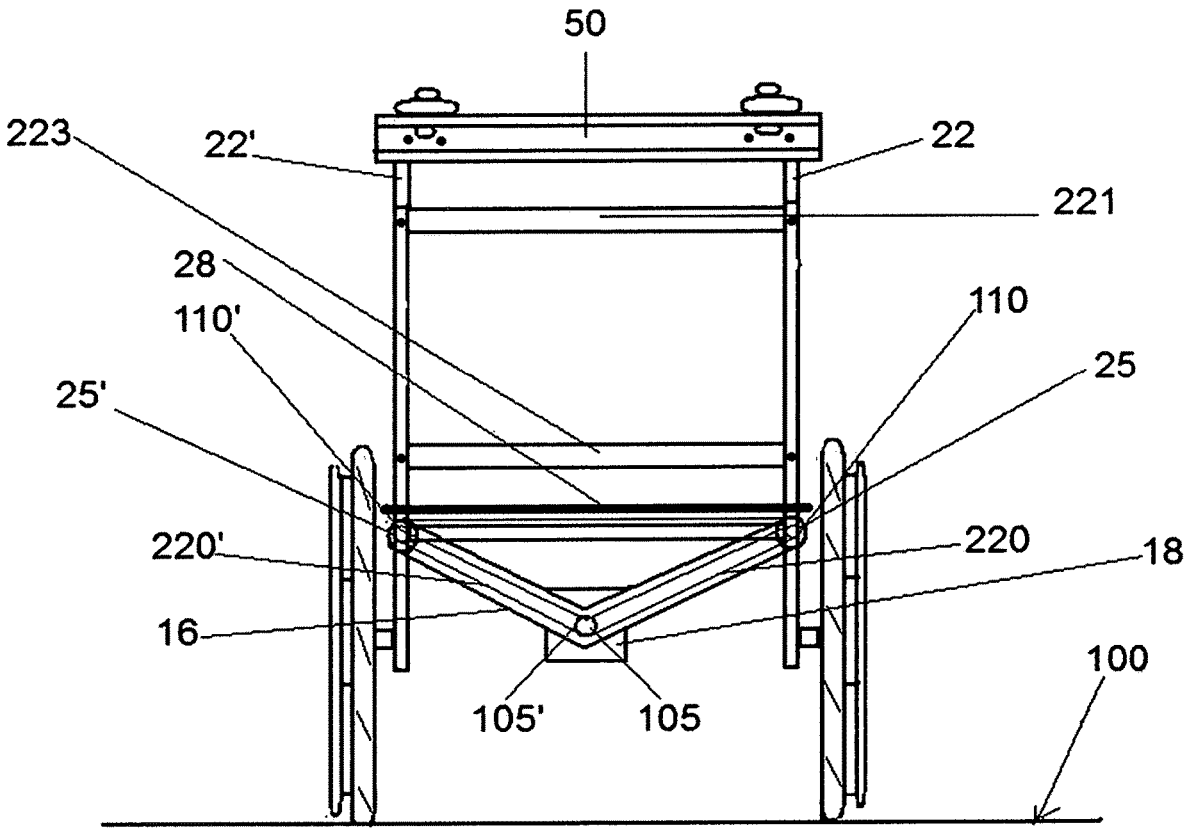
FIG. 1 shows rear view of a wheelchair with a pair of linear actuators on two sides in seated (not lifted) position and a C-shaped member (C-shaped member is sheet that is made of steel and bended in four points like C, and the bends causing it to be more resistant and strong).

50 C-shaped member
22, 22' linear actuators
221, 223 steel rectangle bars
110, 110' straps around rings, sewed and attached at the bottom of the compressible seat
25, 25' rings
220, 220' gear belts
18 gear motor
105, 105' gear belt pulleys attached to gear motor shaft
28 compressible seat
16 V-shaped member
26, 26' linear actuator inner pipes
24, 24' linear actuators threaded rods
23, 23' linear actuators outer pipes
20, 20' linear actuators gear motors
224, 224' rectangular members
21, 21' mounting brackets
226, 226' brackets
51, 51' belts
59 connecting strap
56, 56' bushings
57, 57' screws attaching bushings to C-shaped member
54, 54' quick links
55, 55' square bend U-bolts
69, 69' safety latch
550 back of the user
530 thigh of the user
58, 58' holding straps
102, 102' rear ball bearings
104, 104' front ball bearings
27, 27' seat frame pipes
16 V-shaped member
18 gear motor
108, 108' E-shaped members
101, 101' threaded rods inside seat frame pipes
107, 107' gear belt pulleys attached to threaded rods
29 toilet
30 water tank of the toilet
109 aluminum flange bearings
111 tubes

DETAILED DESCRIPTION OF DRAWINGS

In general, the facilities and accessories connected to the wheelchair which are helping paralyzed person to perform his daily tasks are divided to two separated parts and it is described below:

1. Lifting members.
2. Moving seat.

Figure 2:
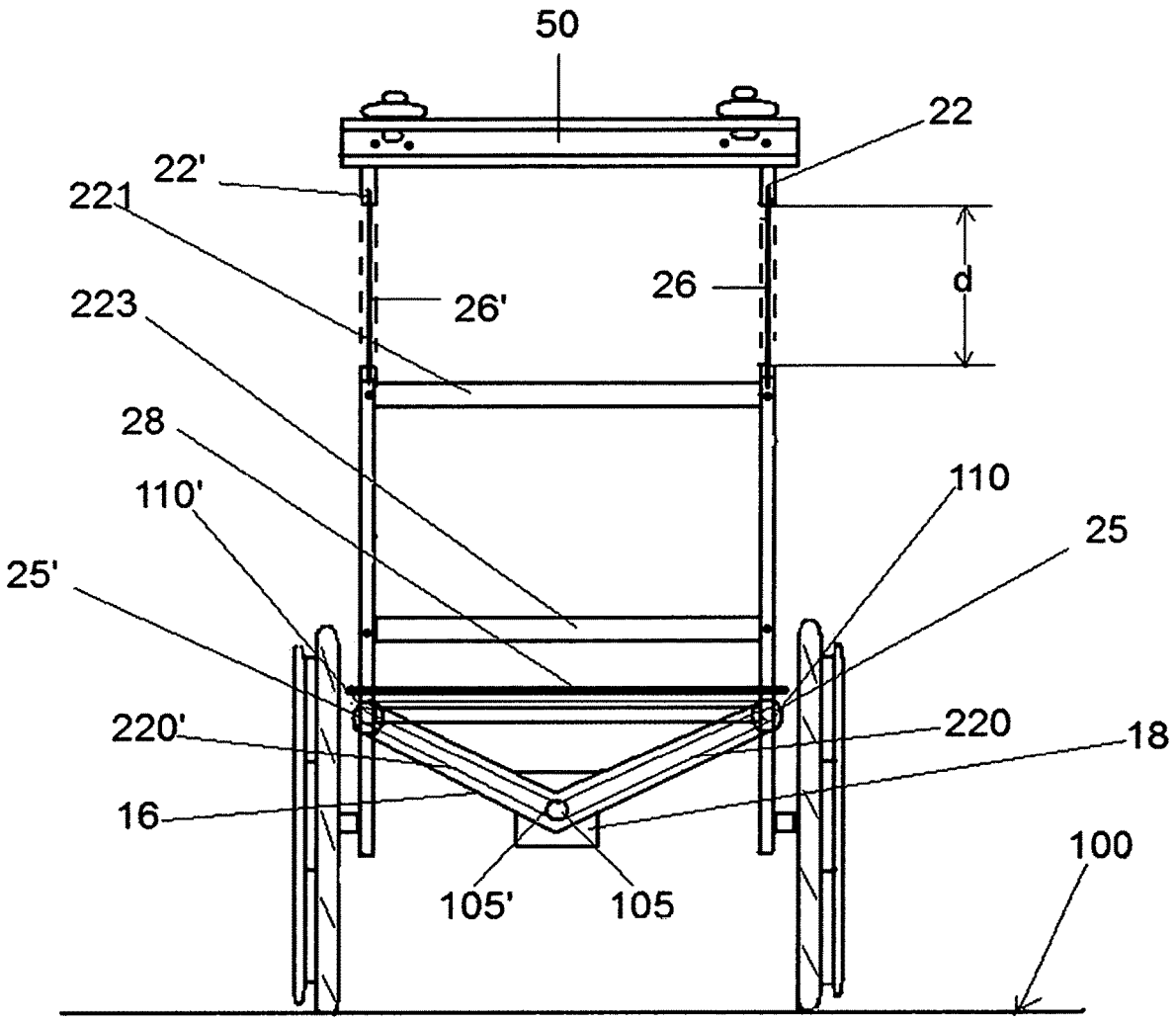
FIG. 2 shows rear view of the wheelchair with the linear actuators on two sides in elevated (lifted) position (after being lifted).

One embodiment of the wheelchair is illustrated in FIG. 1(rear view) and FIG. 2(rear view). Referring now to the drawings in FIG. 1 and FIG. 2 there is shown two separate parts attached to the wheelchair. First part illustrates a pair of lifting members on top part of the wheelchair on backrest of wheelchair. Backrest frame of the wheelchair has been removed and has been replaced with a pair of linear actuators 22, 22' vertically and a pair of steel rectangle bars 221, 223 horizontally. Second part illustrates a moving seat frame. Seat frame of the wheelchair has been removed and has been replaced with moving seat frame.

Here, we describe two parts separately.

1. Lifting Members

Figure 4:
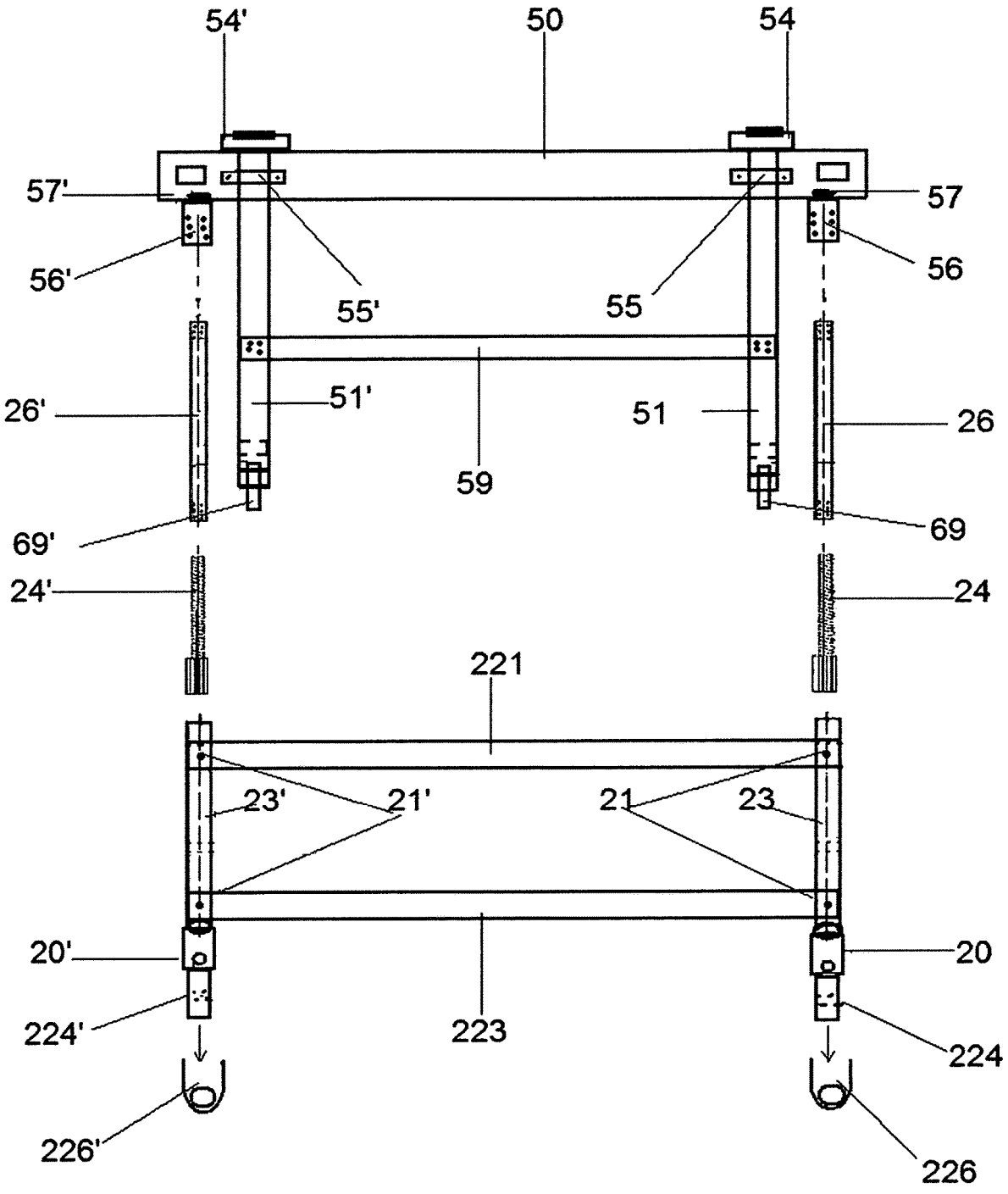
FIG. 4 shows front perspective view of linear actuators (exploded view) with C-shaped member and a pair of bushings, a pair of square bend U-bolts (square bend U-bolt is a bar that has been bent like U and two sides of this bar are threaded, and it has a base), a pair of belts, a pair of quick links (quick link is oval shaped closed hook like ellipsoid), a pair of security latches on two sides, a connecting strap and a pair of steel rectangle bars.

FIG. 4 illustrates front view of lifting members and exploded perspective view of the linear actuators.

A linear actuator is an actuator that creates motion in a straight line. The basic working principle of electric linear actuators is to convert the rotary motion into a linear motion. Each one of the linear actuators consisting of a gear motor, an outer pipe, a threaded rod and an inner pipe, and a rectangular member.

FIG. 4 illustrates the rectangular members, 224, 224' located at the rear end of linear actuators and attached to the bottom of the gear motors 20, 20' and each one of rectangular members 224, 224' has a horizontal hole. The rectangular members attached to a pair of brackets 226, 226' fixed on bottom end of the wheelchair frame pipes by a pair of screws and nuts using horizontal holes. The lifting members can rotate around axis of screws and nuts 90 degree from seated position to horizontal position relative to the seat and set along the wheelchair seat. The rotation is adjustable by a pair of breaks located on the sides of the user. The gear motors 20, 20' are providing the power for linear actuators by using 12V DC or 24*v* DC electricity. The linear actuators 22,22' are being controlled by using a pair of micro switches, and attached inside of front end and rear end of the outer pipes 23, 23'. The start and stop of the linear actuators 22,22' are being controlled by user, with remote control.

The gear motors 20, 20' are attached to the rear end of the outer pipes (main pipes) of linear actuators 23, 23'. The outer pipes positioned vertically and fixed in four points, by a plurality of mounting brackets, two mounting brackets on the right side, 21, and two mounting brackets on the left side 21', to a pair of steel rectangle bars 221, 223 positioned horizontally, and forming a frame. The frame being used as backrest frame of the wheelchair and frame of lifting members.

Figure 3:
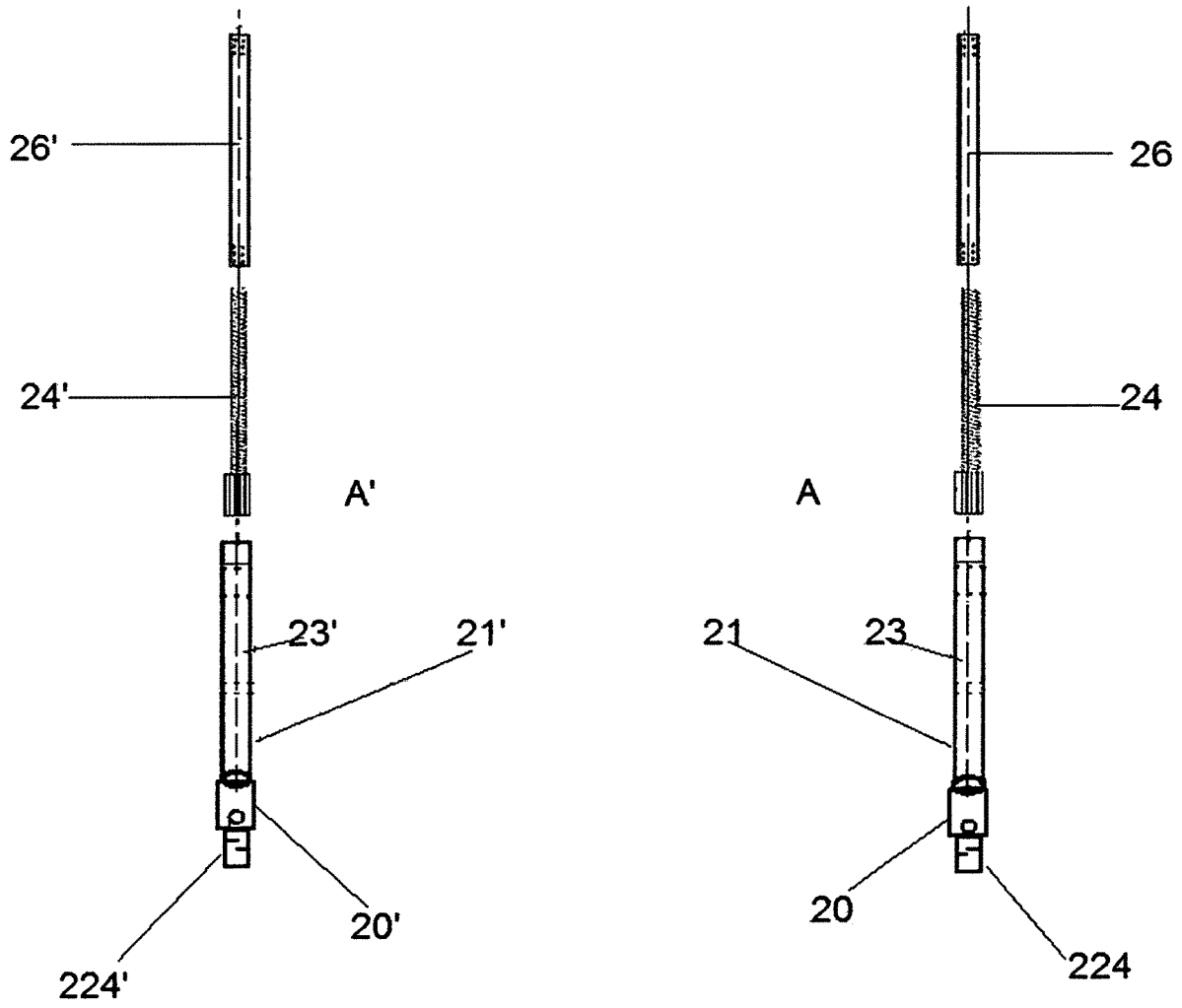
FIG. 3 shows front perspective view of exploded linear actuators.

The outer pipes 23, 23' in FIGS. 3,4 are attached to each one of gear motors, 20, 20', and inside of each one of outer pipes the threaded rods, 24, 24' are attached to a gear motor shaft. The inner pipes 26, 26' has shown in FIGS. 3, 4. The rear ends of inner pipes are attached to the nuts which are coupling with threaded rods, 24, 24'. With rotation of the gear motors, 20, 20' and transferring this rotation to the threaded rods, 24, 24', and rotation is being transferred to the inner pipes, 26, 26' and the inner pipes, 26, 26' having linear-motion upward and downward (having the small node on inner pipes and rotation of threaded rod inside, is causing this linear movement).

Figure 5A:
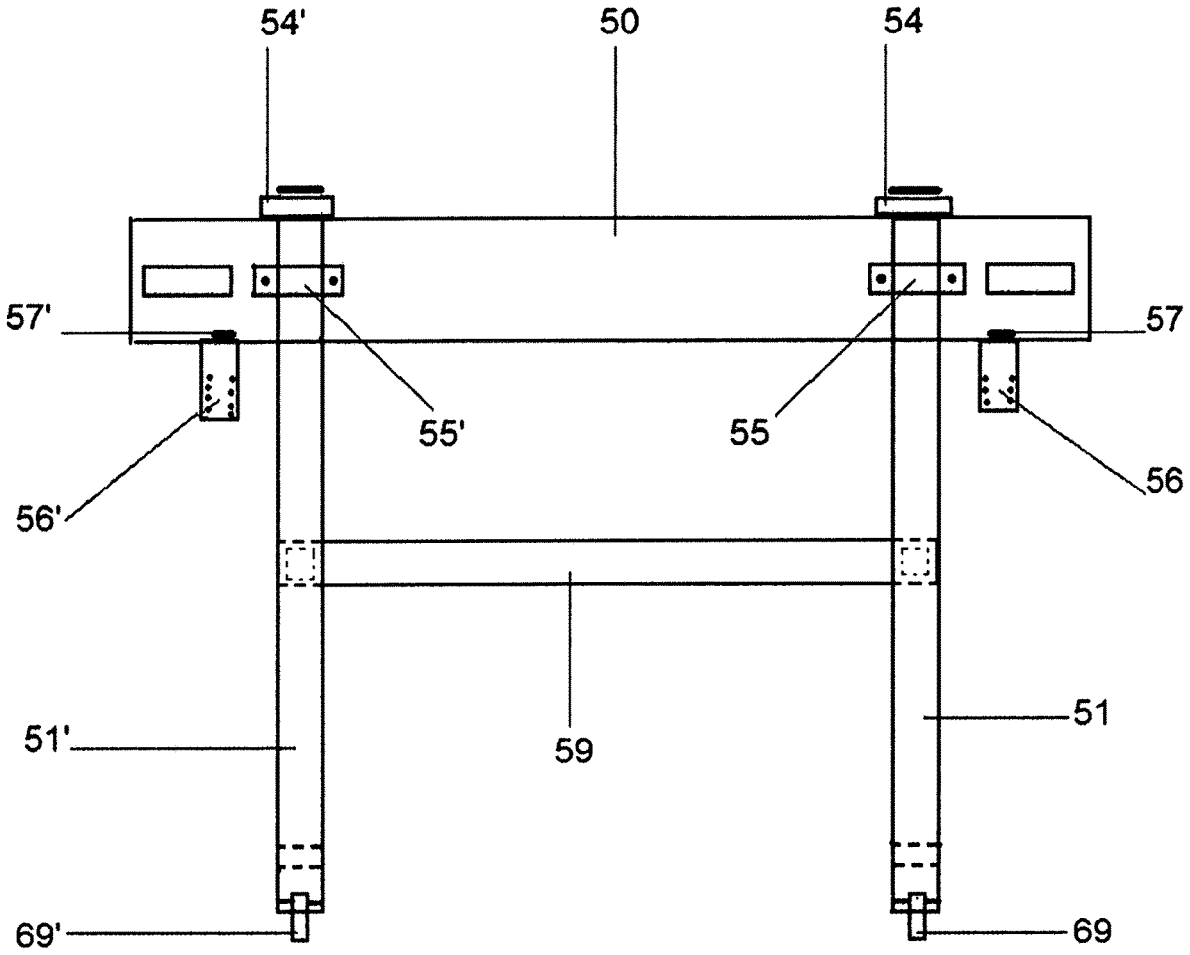
FIG. 5*a* shows front perspective view of connection of the C-shaped member, the quick links, the bushings, the square bend U-bolts, the belts, the connecting strap, and safety latches.
Figure 5B:
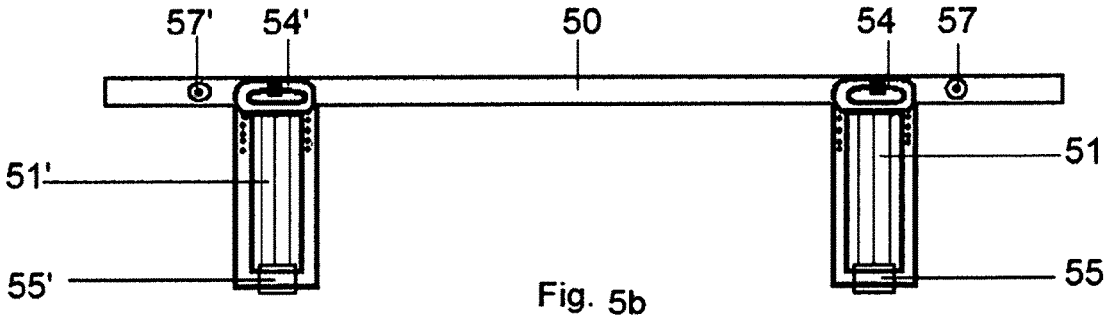
FIG. 5*b* shows top perspective view of connection of the C-shaped member, the quick links, the bushings, the square bend U-bolts, and the belts.

A pair of bushings 56, 56' has shown in FIGS. 4, 5*a*. The head of each one of the inner pipes 26, 26' shown in FIG. 4 can be placed inside of each one of the bushings 56,56' shown in FIG. 4, 5*a* without nuts and screws, attached to two ends of C-shaped member, 50 by screws 57, 57' shown in FIGS. 4, 5*a*,6. The linear actuators and C-shaped member, 50 are not attached to each other by screws and nuts and we can easily separate them (remove them), shown in FIG. 4, on one side, inner pipe 26, bushing 56 and on the other side, inner pipe 26', bushing 56'. The bushings 56, 56' are connected to both bottom sides of a C-shaped member, 50 shown in FIGS. 4, 5*a*, 6. The C-shaped member on top of the wheelchair is in parallel with user's shoulders. A pair of square bend U-bolts 55, 55' shown in FIGS. 4, 5*a*, 5*b*, and adjustable with the size of user's shoulders and located exactly on top of user's shoulders and fixed to the horizontal axis of C-shaped member, 50. A pair of quick links 54, 54' shown in FIGS. 4, 5*a*, 5*b*, and adjustable with the size of user's shoulders, which are located on the C-shaped member sides and the quick links, 54, 54' are fixed on top of the square bend U-bolts, 55, 55'. The C-shaped member, 50 is moving upward and downward when linear actuators are functioning.

The inner pipes of linear actuators 26, 26' on both sides are moving and stopping together with a remote control by the user, so that the inner pipes start going upward together (at the same time) and move downward together (at the same time).

The Linear actuators having linear-motion. FIG. 1 illustrates linear actuators in not lifted (not elevated) position and FIG. 2 illustrates linear actuators in elevated (lifted) position.

A pair of belts 51,51' on two sides of C-shaped member, 50 shown in FIGS. 4, 5*a*, 5*b*, 6 for elevating the user, located on two sides of the wheelchair and hanging on C-shaped member, 50. One end of each one of the belts are attached to the quick links 54,54'shown in FIGS. 6, 7, and the other end of each one of the belts are attached to square bend U-bolts 55,55' shown in FIGS. 6,7. A pair of safety latches 69, 69' has shown in FIGS. 4, 5*a*, 6, 7. Each one of safety latches 69, 69' hanging on each one of the belts, 51, 51'. Each one of safety latches 69, 69' shown in FIGS. 4, 5*a*, 6, 7 is moving on each one of the belts without restraint (freely).

The belts 51, 51' are covering the user's body on the back from shoulders, lower back till thighs and in the front, from chest and lower back till thighs and for security, a connecting strap 59, shown in FIGS. 4, 5*a*, 6, 7, 8 horizontally on the user's back area, is connecting these two belts to each other, so that this system is holding whole paralyzed person's body (supporting user's back).

Figure 6:
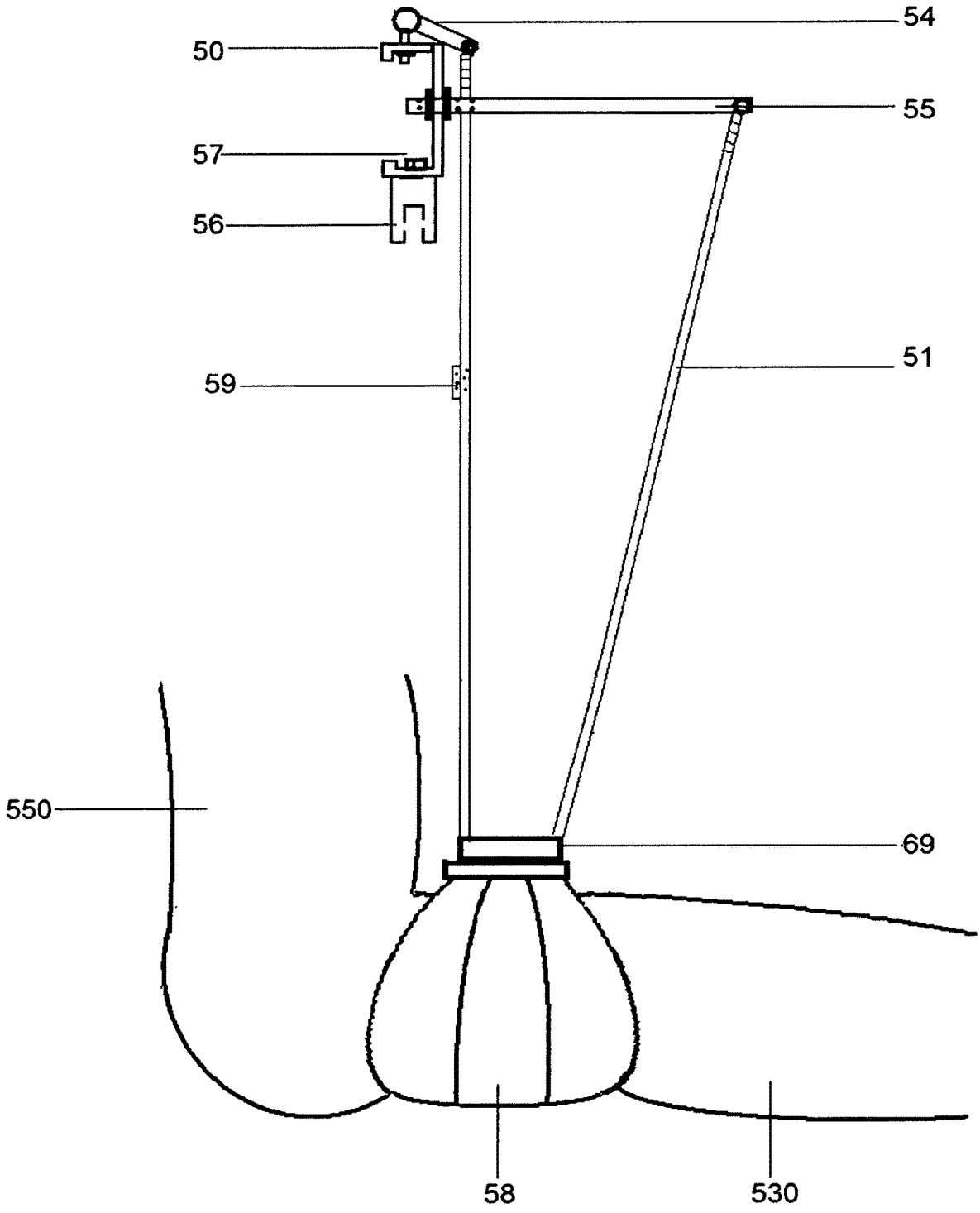
FIG. 6 shows a side perspective view of connection of the C-shaped member, the quick link, the bushing, the square bend U-bolt, the belt the safety latch, the connecting strap, the holding strap, and the holding strap have been fastened around thigh.
Figure 7:
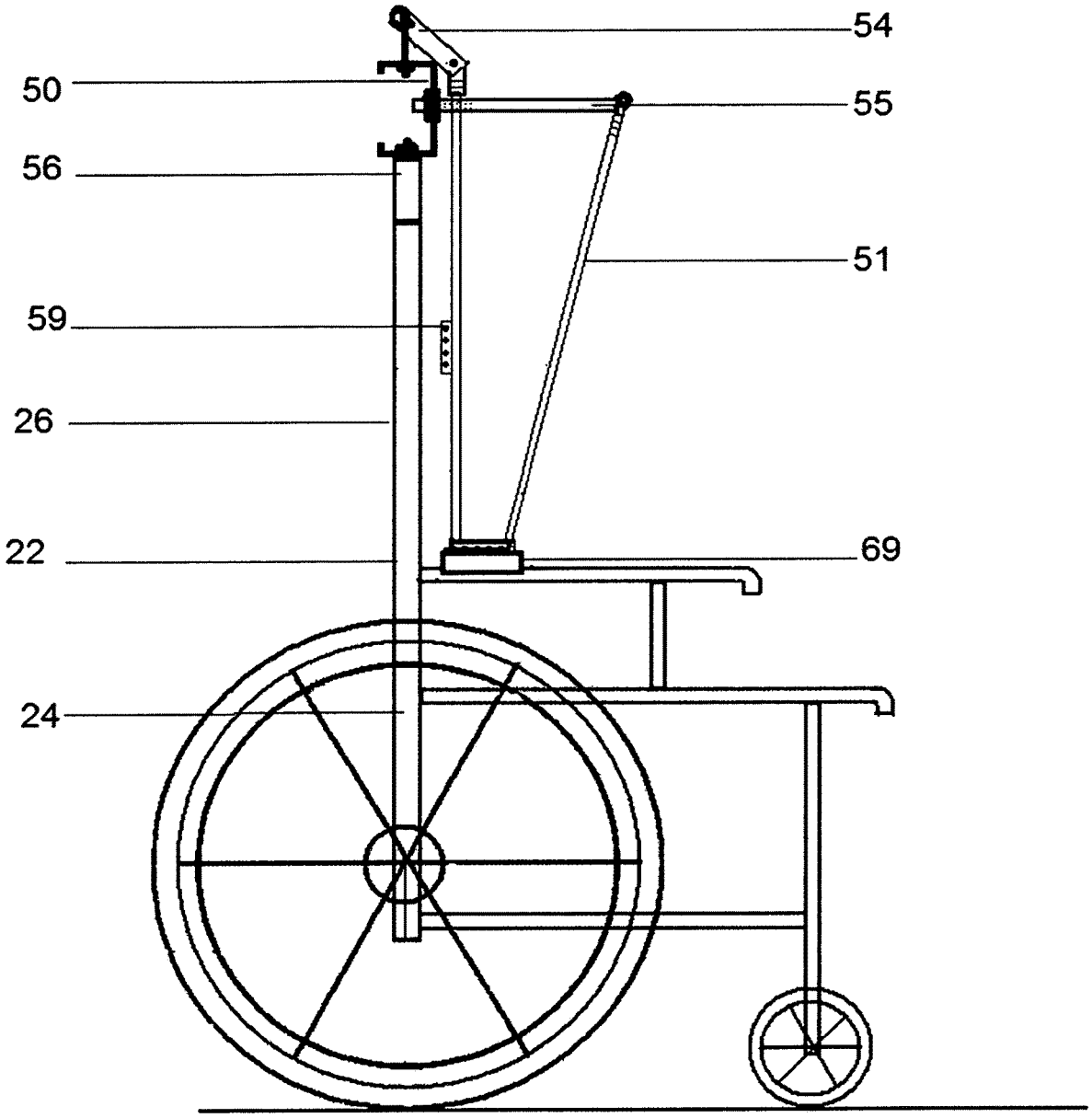
FIG. 7 shows a side perspective view of the wheelchair with the linear actuator, the C-shaped member, the belt, the safety latch, the connecting strap, the square bend U-bolt, the bushing, the quick link, and their connections.

A pair of holding straps 58, 58' in FIG. 6, may be fabric (we contemplate the use of fabric for holding straps, but other materials may be suitable), which are being fastened around user's thighs, on left thigh and right thigh. The holding straps are separated from each other completely. Each one of the holding straps having circle shape and each one of the holding straps is sewed on top. Safety latches on the left and right sides 69, 69' in FIG. 5 are hanging on the belts, and the safety latches are being latched to the holding straps 58,58' shown in FIG. 6 and complete the lifting members.

The holding straps are sewed and each one is being fastened around on each one of the thighs and they are not causing any problems when they are elevating the user.

Putting holding straps on is really easy. When the user is taking off the pants and underwear, he starts putting on the holding straps from his toes and he brings up till thighs. Of course, this function also can be done by others help. The complete drawings of the holding straps and the method of being fastened on the thighs are shown in the FIG. 6.

2. Moving Seat Frame

Figure 10:
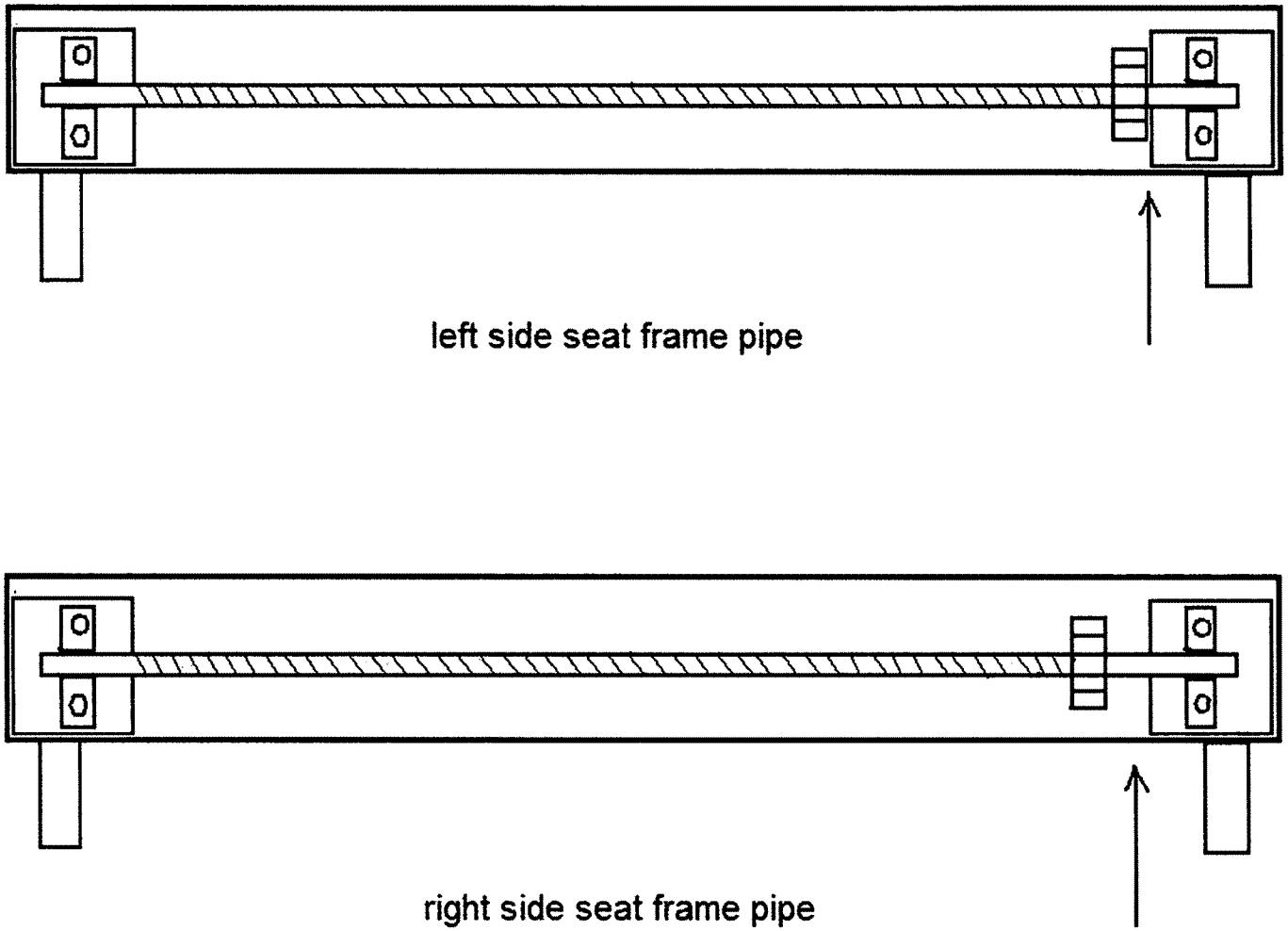
FIG. 10 shows top perspective view of left side seat frame pipe and right side seat frame pipe separately.
Figure 11:
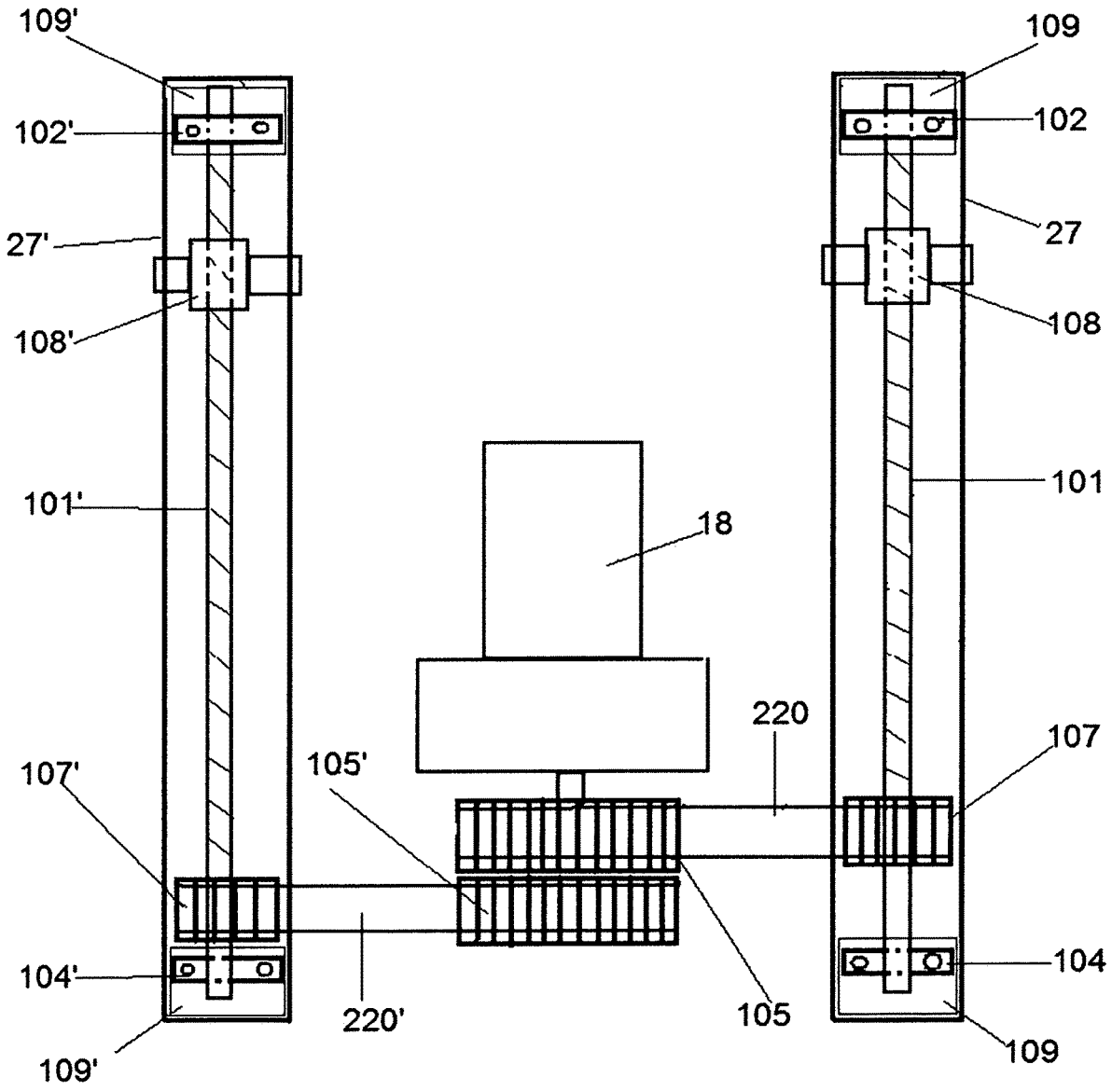
FIG. 11 shows top perspective view of moving seat frame which consists of the gear motor, gear belt pulleys attached to gear motor shaft, two sides gear belts, gear belt pulleys attached to two sides threaded rods, a pair of aluminum flange bearings (aluminum flange bearing is a piece of square aluminum bar that a ball bearing is located inside) attached inside seat frame pipe on the right side and a ball bearing located inside each one and a pair of aluminum flange bearings attached inside left side seat frame pipe and a ball bearing located inside each one, and a pair of E-shaped members, each one coupling with each side threaded rod rear end.
Figure 12:
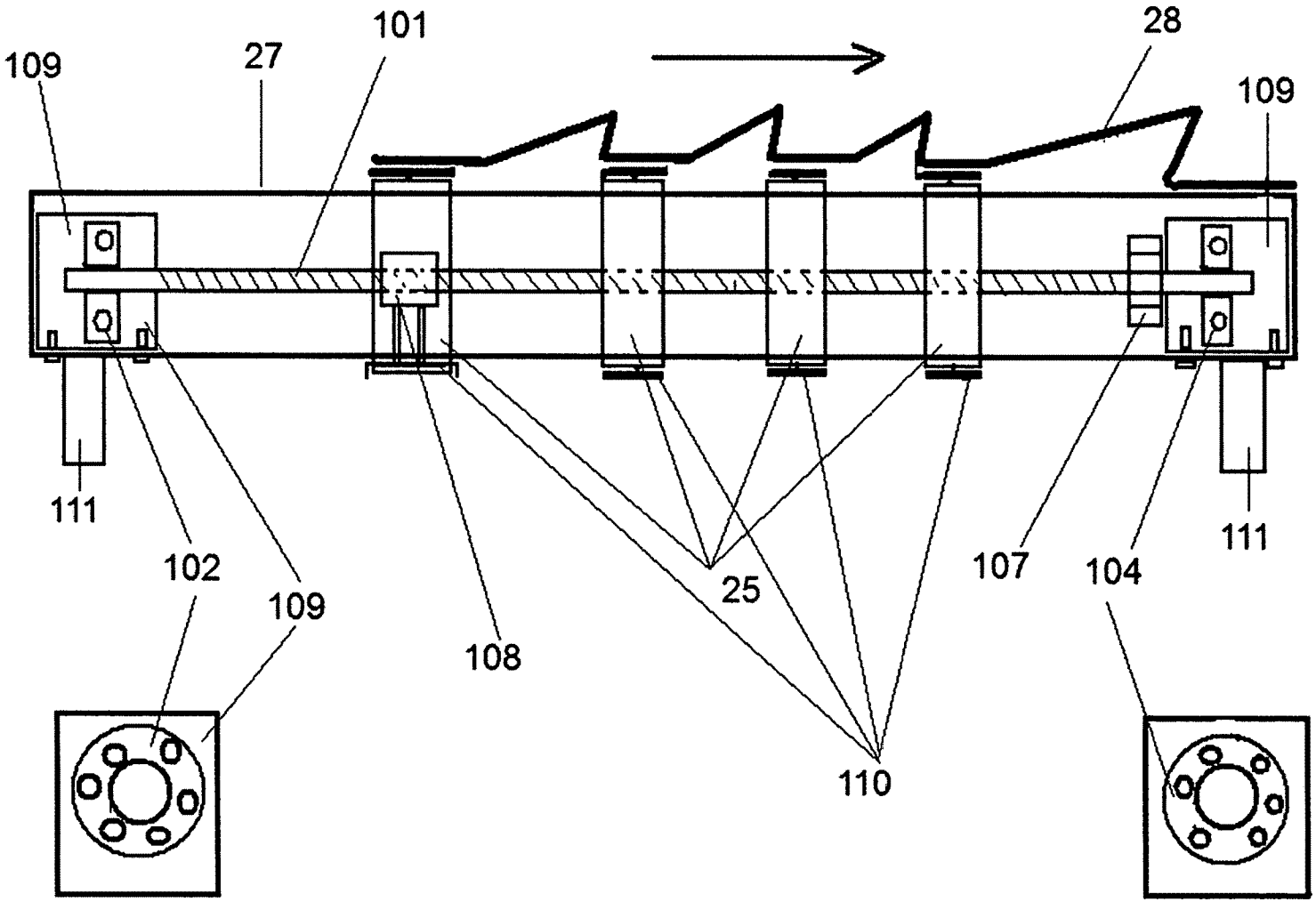
FIG. 12 shows a side perspective view of seat frame pipe with the compressible seat being compressed, with the threaded rod, four rings, the aluminum flange bearings attached on each side of threaded rod and ball bearings inside of aluminum flange bearings, the E-shaped member, and the top view of two ball bearings inside of aluminum flange bearings.
Figure 13:
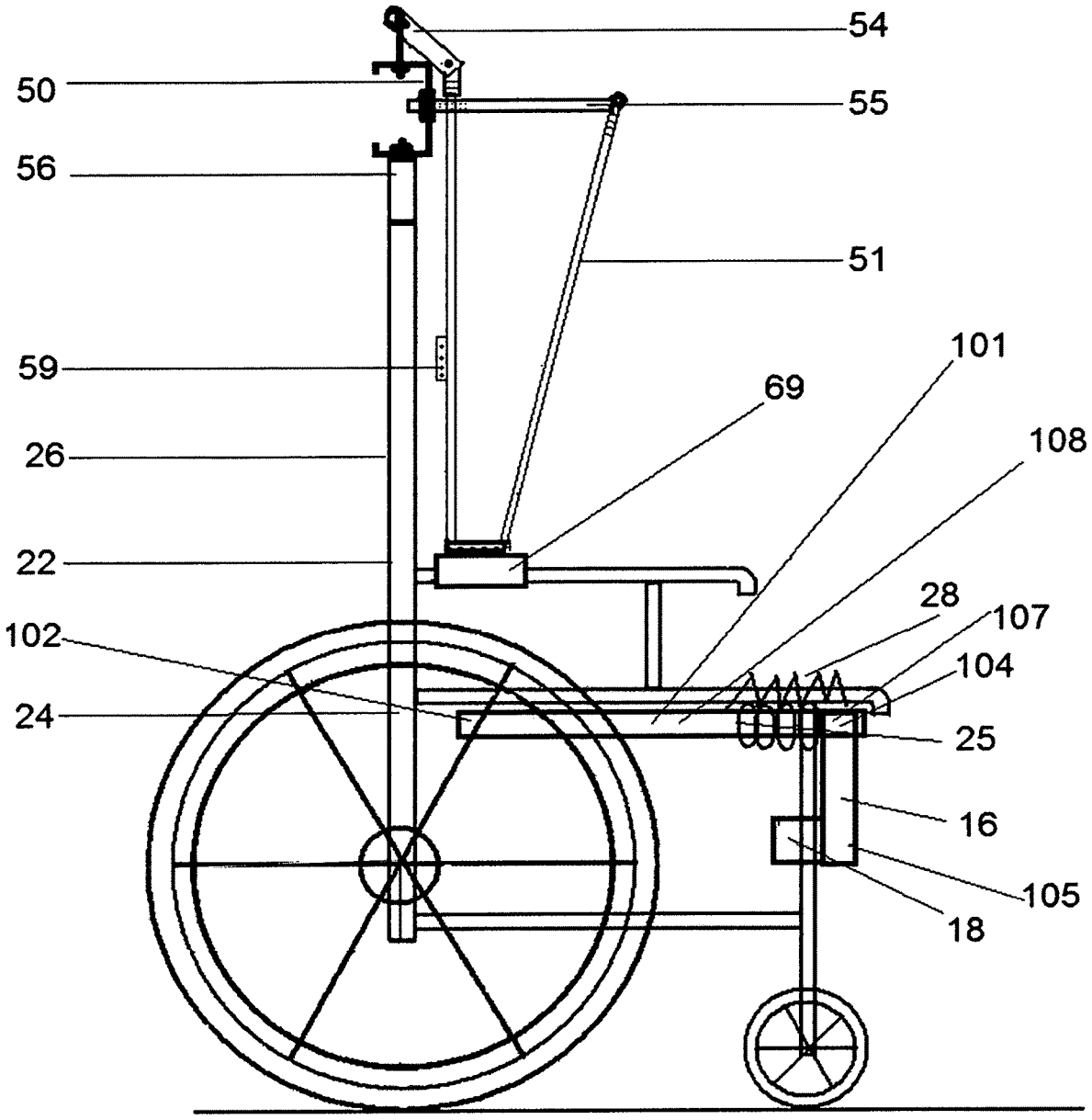
FIG. 13 shows a side perspective view of the wheelchair with lifting members having the linear actuator, the C-shaped member, the belt, the safety latch, the connecting strap, the square bend U-bolt, the bushing, the quick link, and their connections and moving seat in compressed position having a gear motor, a plurality of gear belt pulleys, a plurality of rings, a plurality of ball bearings, a pair of E-shaped members, a compressible seat, a plurality of straps, a pair of gear belts, a V-shaped member, a pair of threaded rods, and a pair of seat frame pipes.

A compressible seat, 28, may be made of thick, soft and strong plastic or leather which has shown in FIGS. 12, 13. A pair of seat frame pipes, 27, 27'each one fixed on the right side and left side of the wheelchair's seat shown in FIGS. 10, 11, 12 and a plurality of rings, 25,25' having symmetric space and located around the seat frame pipes on the right side and left side, shown in FIGS. 8,12,13, and the rings are slidable on two sides seat frame pipes, (can move without restraint). The rings, 25, 25' can be gathered (moved) to the front of seat frame pipes, shown in FIG. 13, causing compressible seat,28 to be compressed (like accordion), shown in FIG. 13.

A plurality of straps, 110, which can be made of strong plastic, sewed (attached) under compressible seat, 28 and attached around the rings 25, which are located around seat frame pipes 27 on left side and right side, shown in FIG. 12 (FIG. 12 shows right side perspective view of seat frame pipe). When the compressible seat, 28 is in normal position (expanded position), the distance between the straps, 110 from each other is equal, and the user's weight is being distributed on the straps evenly, shown FIG. 13.

Figure 14:
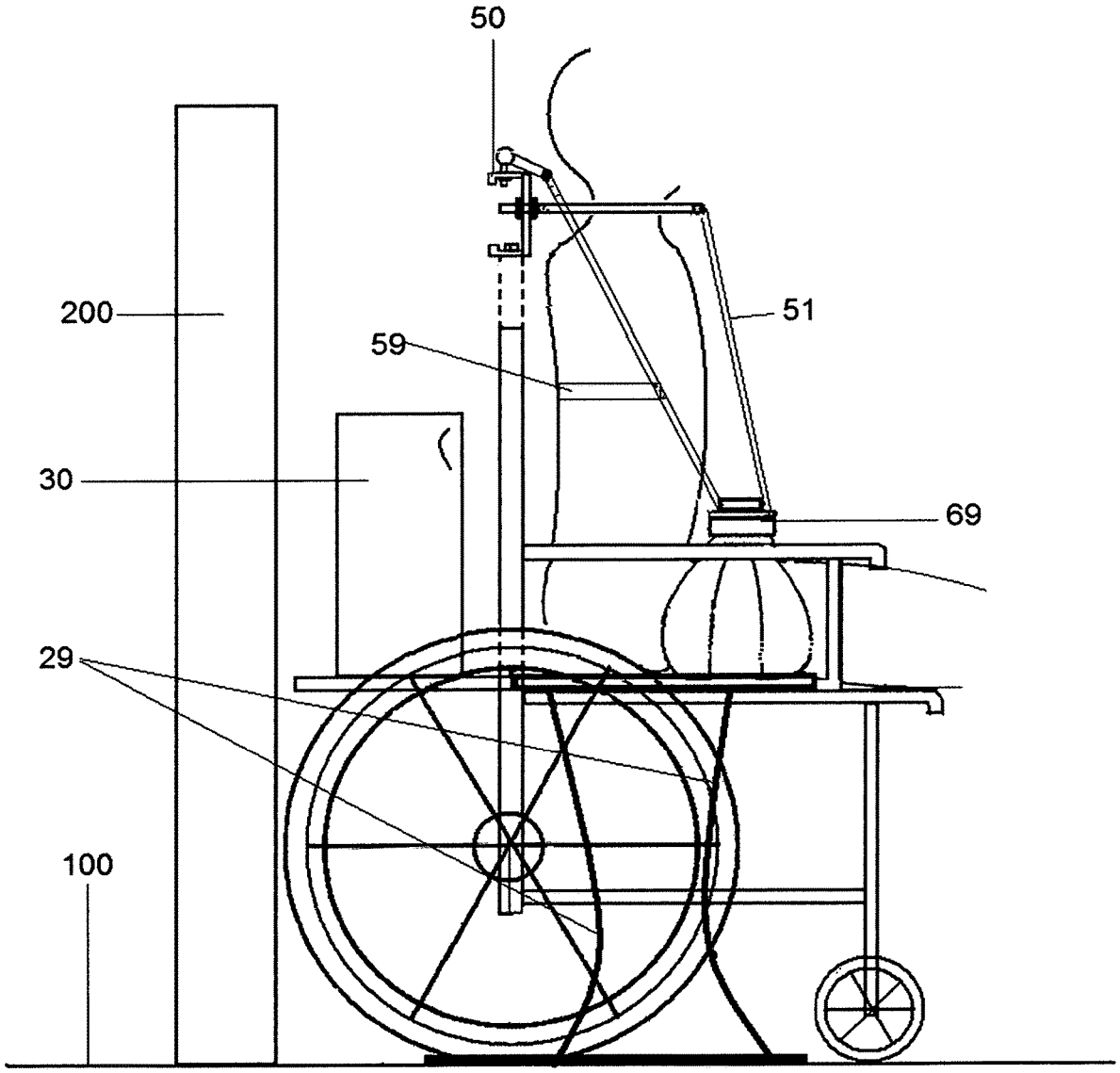
FIG. 14 shows a side perspective view of the wheelchair with the user sitting directly on the toilet and doing toilet, and the holding strap has been fastened around his thigh.

In normal situation the user sitting on the wheelchair. When he needs to do toilet, he is lifting the linear actuators by remote control reaching intended height, d, shown in FIG. 2, then using electrical and mechanical systems, he is compressing the cover seat to the front. After taking off the pants and underwear and sitting on the toilet, 29, shown in FIG. 14 with reverse function of the linear actuators he is sitting on the toilet and he is doing toilet.

Figure 8:
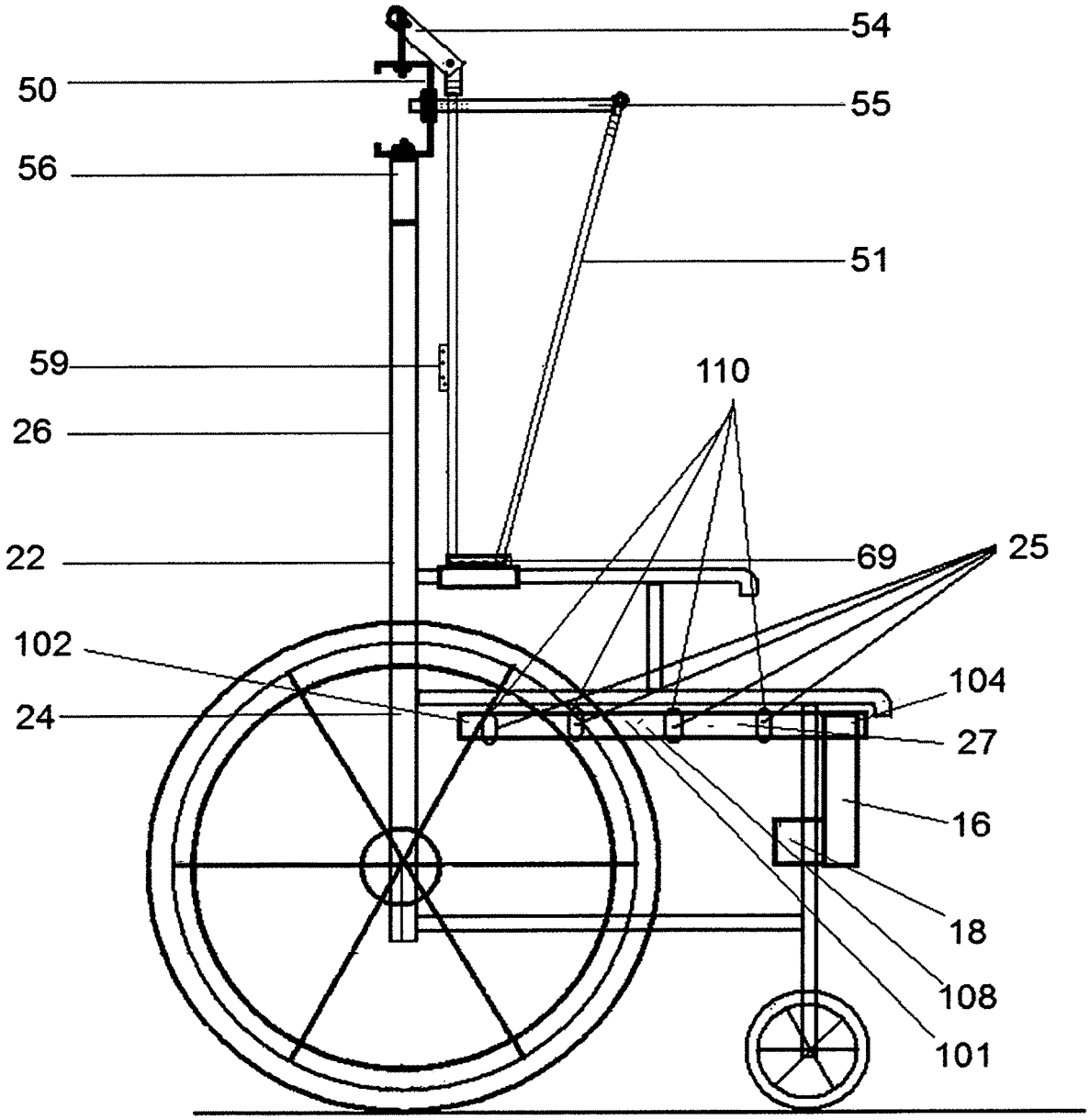
FIG. 8 shows a side perspective view of the wheelchair with lifting members having the linear actuator, the C-shaped member, the belt, the safety latch, the connecting strap, the square bend U-bolt, the bushing, the quick link, and their connections and a compressible seat in extended (stretched)position having a gear motor, a plurality of gear belt pulleys, a plurality of rings, a plurality of ball bearings, a pair of E-shaped members, a plurality of straps, a pair of gear belts, a V-shaped member, a pair of threaded rods, and a pair of seat frame pipes.
Figure 9:
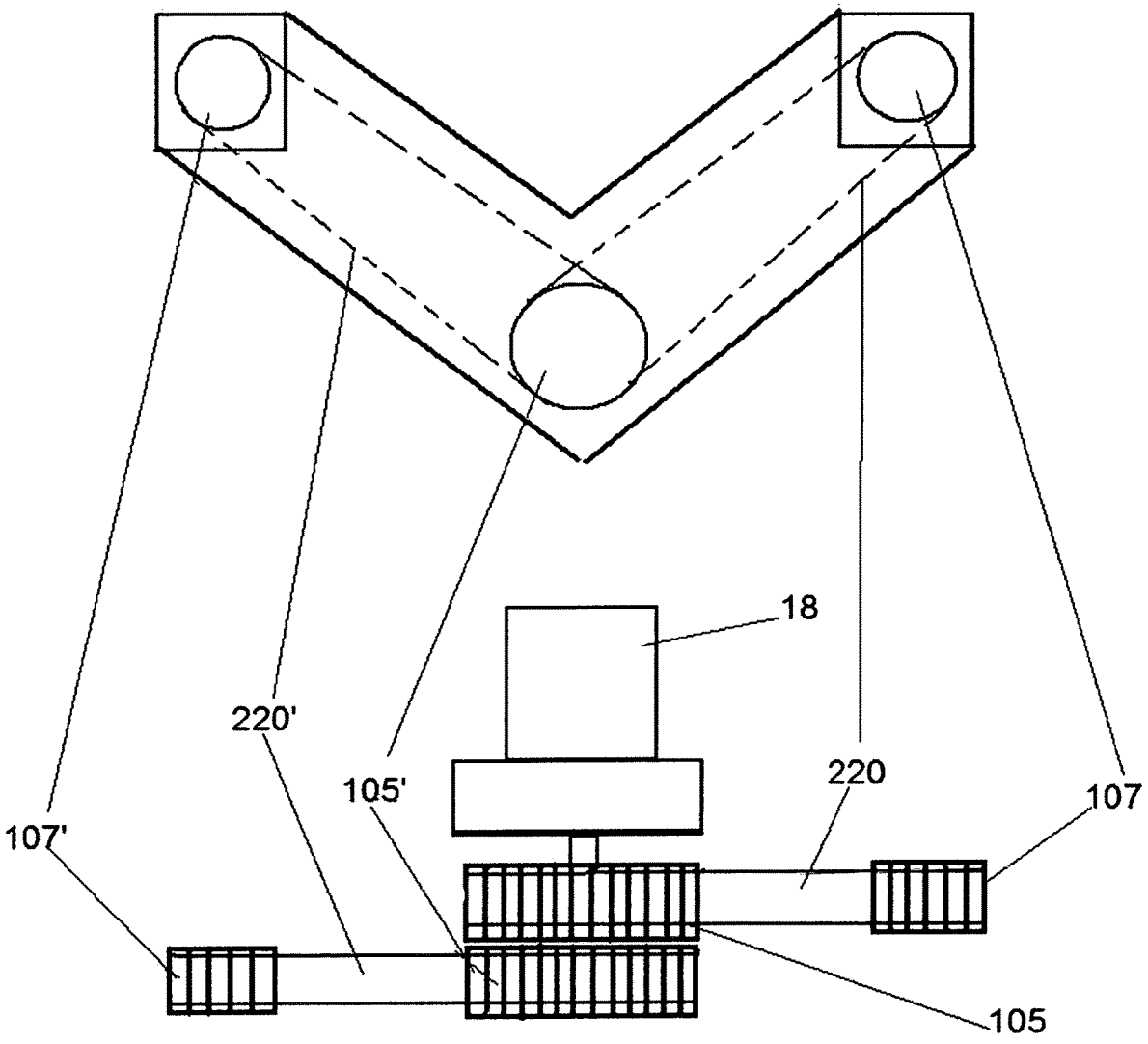
FIG. 9 shows front view of the V-shaped member and top perspective view of internal side of V-shaped member wings which consists of the gear motor, the gear belts, gear belt pulleys attached to gear motor shaft and two sides gear belt pulleys.

A V-shaped member, 16, and its wings which are square tubes shown in FIGS. 8, 9, 13. The V-shaped member is located under the seat frame and in front of the wheelchair and two ends of its wings are attached to the front bottom of the seat frame pipes on the right and left sides. A gear motor, 18 may have the power of 24 volt DC or 12 volt DC, is located on the external angle of V-shaped member, shown in FIGS. 1, 8, 9. A pair of gear belt pulleys 105, 105' attached to a gear motor shaft, and located inside angle of V-shaped member, shown in FIGS. 9, 11. A pair of gear belts, 220, 220' located inside wings of V-shaped member has shown in FIGS. 9,11. A pair of gear belt pulleys 107, 107' attached to front ends of threaded rods inside the left and right side seat frame pipes has shown in FIGS. 9, 11, 12.

The right side gear belt, 220 is wrapped around the first gear belt pulley, 105, attached to the gear motor shaft, in FIG. 11 and the other side of right side gear belt, 220 is wrapped around the right side gear belt pulley, 107 attached to the right side threaded rod, 101 shown in FIG. 11.

The left side gear belt, 220' is wrapped around the second side gear belt pulley, 105' attached to the gear motor shaft, in FIG. 11 and the other side of left side gear belt, 220' is wrapped around the left side gear belt pulley, 107', attached to the left side threaded rod, 101' in FIG. 11.

Gear belt 220, located inside the right side V-shaped member wing, shown in FIG. 11, is transferring the rotary-motion of the gear motor, 18 by gear belt pulley, 105 and gear belt pulley 107, to right side threaded rod 101, shown in FIG. 11. Gear belt 220', located inside the left side V-shaped member wing, shown in FIG. 11, is transferring the rotary-motion of the gear motor, 18 by gear belt pulley, 105' and gear belt pulley, 107 to left side threaded rod, 101, shown in FIG. 11.

A pair of E-shaped members 108, 108' attached to the rear ends of threaded rods 101, 101', on the left and right sides, shown in FIG. 11.

The E-shaped member 108, shown in FIG. 11, 12, located on the right side of the seat frame pipe, 27, which from one side is attached to threaded rod (inside the seat frame pipe) with a nut, and the other side is engaging with the first ring of right side, 25 (outside of seat frame pipe).

The E-shaped member 108', shown in FIG. 11, located on the left side of seat frame pipe, 27', which from one side is attached to threaded rod (inside the seat frame pipe) with a nut, and the other side is engaging with the first ring of left side, 25' (outside of seat frame pipe).

The threaded rods are rotating and transferring this rotation to both sides E-shaped members and causing the E-shaped members move forward and backward.

A plurality of ball bearings 102, 104, 102', 104' attached to threaded rods, 101, 101' located inside right and left side seat frame pipes, 27, 27', shown in FIGS. 11, 12.

The ball bearing, 102 attached to the rear end of right side threaded rod, 101 inside seat frame pipe, 27, shown in FIGS. 11, 12.

The ball bearing, 104 attached to the front end of right side threaded rod, 101 inside seat frame pipe, 27, shown in FIGS. 11, 12.

The ball bearing, 102' attached to the rear end of left side threaded rod, 101' inside seat frame pipe, 27', shown in FIG. 11.

The ball bearing, 104' attached to the front end of left side threaded rod, 101' inside seat frame pipe, 27', shown in FIG. 11.

The sides seat frame pipes 27, 27' having longitudinal groove. The edge of longitudinal groove prevents E-shaped members, 108, 108' from rotating and the E-shaped members having linear-motion. With the rotation of gear motor by user's remote control and transferring this rotation, E-shaped members having linear-motion and in connection with the first rings, on the right and left sides. When the rings are moving forward to the front, starting from the first, then second, third and fourth rings, 25 shown in FIG. 13, so the compressible seat, 28 shown in FIGS. 12, 13 is being compressed to the front completely, and then user can do toilet. After doing toilet, he is using the reverse function, and expanding the compressible seat, 28 will be done shown in FIG. 8.

The seat frame pipes are strong and don't change shapes when user is sitting on compressible seat. The compressible seat, 28, movement is being controlled be a pair of micro switches.

A plurality of aluminum flange bearings, 109, 109' attached inside the rear ends and front ends of seat frame pipes, shown in FIG. 11.

The rear end right side ball bearing, 102 is located inside rear end right side aluminum flange bearing, 109, shown in FIG. 11.

The front end right side ball bearing, 104 is located inside front end right side aluminum flange bearing, 109, shown in FIG. 11.

The rear end left side ball bearing, 102' is located inside rear end left side aluminum flange limiting, 109', shown in FIG. 11.

The front end left side ball bearing, 104' is located inside front end left side aluminum flange bearing, 109', shown in FIG. 11.

A pair of tubes, 111, each one attached to the bottom rear end of two sides seat frame pipes shown in FIG. 12, and a pair of tubes, 111, each one attached to the bottom front end of two sides seat frame pipes shown in FIG. 12. The tubes are connecting the seat frame pipes 27, 27' to the wheelchair seat frame.

Complete mechanical and electrical system mentioned above are being used when user (paralyzed person) is doing toilet and the basin or toilet is located under wheelchair's seat, therefore the compressible seat is being pulled to the front so the user (paralyzed person) can sit on the basin or toilet directly.

As we described all the details of first part (lifting members) and second part (moving seat) above, here we describe doing daily tasks:

Doing daily tasks which in fact is the result of first part and second part functioning together, and doing toilet using two described parts. In addition to using the toilet, user can do other daily tasks also, and these daily tasks are:

1. Changing underwear and clothes.
2. Washing hands and face.
3. Cooking and washing the dishes.
4. Moving from wheelchair in the bed and vice versa.
5. Washing the body in the shower (shower that has been made for paralyzed person)

The method for using the toilet in the restroom is described below:

1. Moving the wheelchair on top of the toilet or mobile toilet, All the accessories and parts of lifting members and also compressible seat ready for doing toilet.
2. Break on top of the toilet.
3. Setting up electrical system
4. Fastening the safety latches to the holding straps around the thighs (the user has already put on the holding straps).
5. Moving linear actuators upward by using the remote control for linear actuators and lifting himself up till intended height, so that he feels comfortable to take off the pants and underwear (FIG. 2, 6).
6. Taking off the pants and underwear.
7. Using electricity (on-off switch) for compressing the compressible seat to the front.
8. Moving linear actuators downward by using the remote control to sit on the toilet (the reverse function of the linear actuators and sitting completely on the toilet or mobile toilet).
9. Doing toilet and moving linear actuators upward again using remote control.
10. Cleaning up himself and putting on pants and underwear.
11. Expanding the compressible seat to its primary position (reverse function to set the seat to its primary position).
12. Moving linear actuators downward and sitting on the compressible seat.

Considering he can do all these functions, he can do all other daily tasks also.

When the bathroom door is not big enough for the wheelchair to enter the restroom, the paralyzed person has to use the mobile toilet outside of the restroom.

The equipment used on the wheelchairs (either designed wheelchair or pieces and equipment for installing on some types of wheelchairs) are different for kids, old people and middle aged people, and considering their weight and abilities will be different.

According to the points mentioned above, the reader will see that design and build new models of wheelchairs, and design and build equipment that are installable on some types of wheelchairs being sold in the market, has been done, so that paralyzed person can do his personal daily tasks (mentioned above) without others help, of course in these designs daily tasks will be done faster, easier and more hygienic.

But doing daily tasks and in general creating movements, either physical or mental in paralyzed person is the same as feeling of the life and being alive that is being flourished in his existence and these actions are causing him not to feel like a burden anymore and even feel more independent. So he will be in much better situation emotionally. So that he can have detailed schedule in his daily life, even like a normal person with complete physical health.

The result of this project is that paralyzed person is participating in social life as normal person, and in result he will have much better mental and physical health.

We claim:

1. A rehabilitation wheel chair comprising:

a wheel chair frame;

a lifting member mounted on said wheel chair frame; and a compressible seating surface;

said lifting member comprising a pair linear actuators extending substantially perpendicular to the compressible seating surface and a C-shaped frame member, the C-shaped frame member including:

a first bushing mounted on a right side and a second bushing mounted on a left side wherein each of said bushings extend substantially perpendicular to said C-shaped member, a top end of each of said pair of linear actuators removably received in a respective one of said first and second bushings, such that extension and retraction of said linear actuators raises and lowers said C-shaped frame member;

at least one holding strap, wherein the at least one hold strap is configured to attach to a seat occupant such that extension and retraction of said linear actuators lifts and lowers a seat occupant to and from the compressible seat surface.

2. The rehabilitation wheel chair of claim 1 further comprising: a first square bend u-bolt mounted substantially perpendicular to one side of said C-shaped frame member; a second square bend u-bolt mounted substantially perpendicular to a second side of said C-shaped frame member wherein a distance between said first square bend u-bolt and said second square bend u-bolt can be varied by adjusting the position of each square bend u-bolt with respect to said C-shaped frame member.

3. The rehabilitation wheel chair of claim 2 further comprising: a first belt mounted to said first square bend u-bolt with a first quick link and a second belt mounted to said second square bend u-bolt with a second quick link, the first and second belts attached via a connecting strap configured to be positioned behind a seat occupant's back.

4. The rehabilitation wheel chair of claim 3 further wherein the at least one holding strap comprises: a first holding strap having a closed-hook latch and extending from said first belt and a second holding strap having a closed-hook latch extending from said second belt, wherein the first and second holding straps are each configured to wrap around a user's thigh.

5. The rehabilitation wheel chair of claim 1, wherein the wheel chair frame comprises a seat frame; a pair of side pipes mounted on said seat frame; a plurality of rings mounted to said compressible seat and slideable along a first of said pair of side pipes and a second plurality of rings mounted to said compressible seat and slideable along a second of said pair of side pipes; wherein said rings are slideable along one of said pair of side pipes to retract said compressible seat from an extended configurations.

6. The rehabilitation wheel chair of claim 5, wherein said compressible seat is supported on an underside by a series of parallel straps, opposite ends of each strap connected to one of said plurality of rings.

7. The rehabilitation wheel chair of claim 5, further comprising: an actuator configured to retract said compressible seat from an extended position to a retracted position, wherein said actuator comprises a gear motor, a pair of gear belts, a pair of gear belt pulleys, a pair of threaded rods, and a pair of E-shaped members wherein said motor rotates said pair of threaded rods and said pair of E-shaped members move said rings forward and backward along said respective side pipes to retract and extend said compressible seat.

* * * * *